United States Patent [19]

Gidon et al.

[11] Patent Number: 4,689,282

[45] Date of Patent: Aug. 25, 1987

[54] METHOD AND PAPER FOR PRINTING BY MAGNETOGRAPHY AND DOCUMENTS PRINTED ON PAPER OF THIS TYPE

[75] Inventors: Georges Gidon, La Balme de Sillingy; Claude Richard, Jouy en Josas, both of France

[73] Assignee: Aussedat Rey, France

[21] Appl. No.: 815,965

[22] Filed: Jan. 3, 1986

Related U.S. Application Data

[63] Continuation of Ser. No. 545,919, Oct. 27, 1983, abandoned.

[30] Foreign Application Priority Data

Nov. 4, 1982 [FR] France ..... 82 18471

[51] Int. Cl.[4] ..... G03G 13/00; G03G 19/00

[52] U.S. Cl. ..... 430/39; 162/138; 428/511; 428/514; 428/537.7

[58] Field of Search ..... 162/138; 428/511, 514, 428/537.7; 430/39

[56] References Cited

U.S. PATENT DOCUMENTS 4,058,648 11/1977 Louden ..... 428/511

4,500,607 2/1985 Louden et al. ..... 428/511

*Primary Examiner*—James C. Cannon

*Attorney, Agent, or Firm*—George H. Gerstman

[57] ABSTRACT

A method for printing by magnetography under atmospheric conditions of relative humidity exceeding 65 or even 75% consists in transferring to a sheet of paper a fusible magnetic ink in powdered form which is distributed on a temporary magnetizable support in accordance with the configuration to be produced, whereupon the ink is fixed by fusion on the sheet of paper. The paper has a surface resistivity of at least $10^{10}$ ohms square and a relative smoothness of at least 20 Bekk.

10 Claims, 1 Drawing Figure

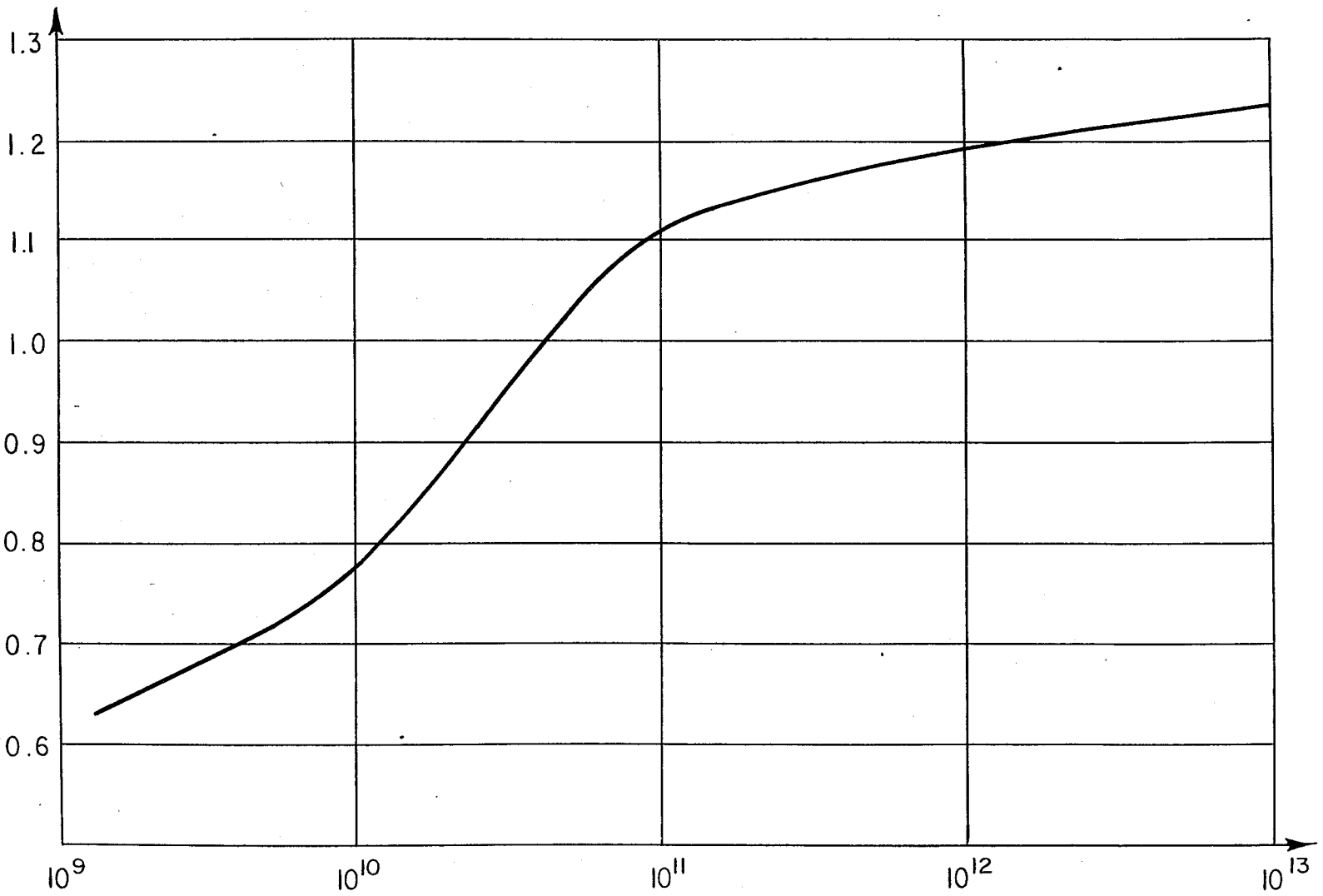
1.3
1.2
1.1
1.0
0.9
0.8
0.7
0.6
$10^9$
$10^{10}$
$10^{11}$
$10^{12}$
$10^{13}$

METHOD AND PAPER FOR PRINTING BY MAGNETOGRAPHY AND DOCUMENTS PRINTED ON PAPER OF THIS TYPE

This is a continuation of application Ser. No. 545,919, filed Oct. 27, 1983, now abandoned.

This invention relates to magnetography or in other words to a printing process involving the use of a magnetic drum on which is produced a magnetic image of the impression to be formed, whereupon particles of solid metallic ink generally known as a "toner" are caused to adhere to said metallic image, thus revealing the recorded image. By pressing the drum against a sheet of paper, the ink is transferred to the paper on which it is fixed by heating. Fusible magnetic inks are employed for this purpose.

When it is desired to produce impressions by magnetrography in environments having high relative humidity above approximately 50%, grey results are usually obtained as a result of poor transfer of the ink to the paper.

The problem therefore consists in obtaining sharply defined copies in environments which have high humidity but are nevertheless usually encountered in residential premises in temperature countries.

Printing by magnetography is more particularly advantageous for high-speed printing of documents delivered by computers.

Up to the present time, researches have apparently been directed essentially to the nature and properties of ink but the paper employed has consisted of either ordinary paper or types of paper which have been specially studied for printing by electrography but have proved disappointing.

When the paper was exposed to relative humidity of the air exceeding 50%, the printing result or impression was very pale or, in other words, had low optical density.

In the case of inks employed up to the present time, magnetographic printing calls for the use of paper having a low moisture content which has to be maintained by means of an air-tight wrapping which protects the paper against ambient humidity up to the moment of printing. In point of fact, however, the printing machine must be capable of operating in non-conditioned atmospheres.

The aim of the invention is to overcome the drawbacks of magnetography in highly humid environments and to produce acceptable printed products without any need for special precautions, even at high values of ambient humidity.

The invention is directed to a method of printing by magnetography under ambient atmospheric conditions of relative humidity which may exceed 65%. This method consists in transferring to a sheet of paper a fusible magnetic ink in powdered form which is distributed on a temporary magnetizable support in accordance with the configuration to be reproduced, whereupon the ink is fixed by fusion on the sheet of paper. The distinctive feature of the method lies in the use of a sheet of paper which has a surface resistivity of at least $10^{10}$ ohms square under the conditions of relative humidity of transfer and which has a relative smoothness of at least 20 Beck.

The invention also relates to a sheet of paper for printing by magnetography under atmospheric conditions of relative humidity which may exceed 75%. The sheet is distinguished by the fact that it has a surface resistivity of at least $10^{10}$ ohms square as measured with the Keithley apparatus after exposure at 20° C. in an environment having a relative humidity of 30% during a period of one hour, then at 23° C. in an environment having a relative humidity of 50% over a period of at least ten hours, and that the paper has a relative smoothness of at least 20 Bekk.

It is an advantage to ensure that a sheet of paper in accordance with the invention contains practically no whitening agent and practically no electrolyte.

In one embodiment, a sheet of paper for magnetography in accordance with the invention has a surface layer of mineral pigments in a non-hydrophilic binder on the sheet face which is intended to take the impression. A mineral pigment of this type advantageously consists mainly of calcium carbonate in the form of powder which has a mean particle diameter of the order of one micron and in which approximately 80% of the particles have a diameter of less than approximately two microns.

The binder is advantageously constituted at least partly by a substance of the group comprising the acrylate and styrene copolymers, polyvinyl alcohol, the ureaformaldehyde resins without either plasticizer or solvent.

In another embodiment, use is made of a sheet of paper having a porosity of the order of 200 to 300 as measured in accordance with the Bendtsen method and a pH value below 7. This corresponds to a sheet of paper without any special coating and made of paper pulps selected as a function of their chemical purity or in other words practical absence of foreign ions, especially sodium, potassium, chlorine, sulfur, and of their high intrinsic surface resistivity.

Refining of the paper pulp must be reduced to a minimum, taking into account the mechanical strength of the paper which it is desired to obtain.

The proportion of mineral fillers must be as high as possible within the limits of mechanical strength of the desired paper.

Finally, the paper must be manufactured in a fairly acid medium.

The optical printing density achieved on a magnetographic printer depends on the electrical surface resistivity at the moment of printing (this factor being of major importance) but also on the relative surface smoothness which must be higher than 20 Bekk (this factor being nevertheless of secondary importance).

The values of surface resistivity indicated in this description are those measured by means of the Keithley apparatus with suitable electrodes for measurements in "ohms square".

In the case of paper which is neither surface-pigmented nor coated, in other words in the case of papers of practically uniform constitution throughout their thickness, it is possible to establish a direct relationship between the optical density of the magnetographic printing images and the surface resistivity. This relationship is materialized by the curve shown in the single figure of the accompanying drawings. This curve shows a very sharp increase in the optical density of the printing image between the levels of surface resistivity of $10^{10}$ and $10^{11}$ ohms square. The optical density of the printing images can be considered as satisfactory above the value of 1.0 and unsatisfactory below 0.8. The values of surface resistivity within the range of $10^{10}$ to $5\times10^{10}$ ohms square can thus be considered as representing a resistivity threshold above which the surface resistivity of the paper must be situated at the moment of printing. Experience shows that the majority of papers have a resistivity below this threshold value when they are subjected to atmospheric conditions in which the relative humidity of environmental air is at least 55 to 65%. Such papers are therefore unsuitable for magnetographic printing in climates in which the relative humidity exceeds 55 to 65%.

The surface resistivity is in fact a rapidly decreasing function of the relative humidity of the paper at equilibrium.

Broadly speaking, any method for reducing the hygroscopicity of the paper or in other words the moisture absorption capacity of the paper when it is subjected to a given climate, will provide favorable conditions for magnetographic printing. A lower water content in fact produces an increase in resistivity and it has been observed that the logarithm to the base 10 of the surface resistivity is a decreasing linear function of the logarithm of the water content.

The invention is also concerned with the documents printed by magnetography on papers in accordance with the invention.

A more complete understanding of the invention will be gained from the following description of a few non-limitative examples of embodiments in accordance with the invention.

EXAMPLE I

A paper pulp is prepared by introducing upstream of the paper machine the substances which constitute the pulp suspension:

- bleached hardwood chemical pulp—52%
- bleached coniferous or softwood chemical pulp—35%
- mixture of talcum powder and china clay in equal parts—13%
- sizing products and retaining agents in the usual quantities.

The surface of the sheet of paper thus formed is coated by means of a so-called "surface sizing press" with a preparation containing the following products:

- 420 kg of powdered chalk having a mean particle diameter of 1 micron in which 80% of the particles have a diameter of less than 2 microns, of the type marketed by the Omya Company under the trade name of Omyalite,
- 150 kg of a 50% aqueous suspension of a copolymer of acrylate and styrene which is free of plasticizers and solvents, of the type marketed by the BASF Company under the trade name of Latex S 320 D,
- 10 kg of a 40% anionic aqueous suspension of a copolymer of acrylates of the type marketed by the BASF Company under the trade name of Acrosol,
- 5 kg of a polyvinyl alcohol having a degree of hydrolysis higher than 98 and low viscosity within the range of 7 to 11 centipoises, this viscosity being measured in a 4% aqueous solution at 20° C.,
- 20 kg of an anionic urea-formedalhyde resin in a 63% solution in water of the type marketed by the Rousselot Company under the trade name of Resine 41-22,
- 1 kg of a dispersing agent of the type which has a polyacrylamine base and sold by the BASF Company under the trade name of Polysel.

The foregoing composition is diluted with water up to 1000 kg.

No fluorescent whitening agent or other optical colorants.

This preparation is deposited on the sheet in a proportion of approximately 16 g/m$^2$, namely 8 g/m$^2$ on each face.

Finally, the sheet is subjected to a calendering operation in order to have a surface smoothness which is greater than 20 Bekk.

EXAMPLE II

A paper pulp is prepared with the same materials as in Example I.

The sheet of paper thus formed is subjected to a surface coating operation by means of a trailing-blade coating machine which has higher performance than the surface sizing press of Example I and makes it possible to apply a coating to a single face with more uniform deposition.

The coating operation is carried out with a basic preparation containing the following products:

- 350 kg of powdered chalk having a mean particle diameter of 1 micron in which 80% of the particles have a diameter of less than 2 microns, of the type which is commercially available under the trade name Omyalite and marketed by the Omya Company,
- 140 kg of a 50% aqueous dispersion of an acrylate and styrene copolymer which is free of plasticizers and solvents, of the type which is marketed by the BASF Company under the trade name S 320 D,
- 6.5 kg of a 40% anionic aqueous suspension of a copolymer of acrylates which is free of plasticizers and solvents, of the type sold by the BASF Company under the trade name Acrosol,
- 4.5 kg of a polyvinyl alcohol having a degree of hydrolysis which is higher than 98 and a low viscosity within the range of 7 to 11 centipoises, this viscosity being measured in a 4% aqueous solution at 20° C., of the type marketed by the Rhone-Poulenc Company under the trade name of Rhodoviol 8.20,
- 15 kg of an anionic urea formaldehyde resin in a 63% solution in water such as the resin marketed by the Rousselot Company under the trade name Resine 41-22,
- 1 kg of dispersing agent of the type marketed by the BASF Company under the trade name of Polysel.

The preparation is diluted to 1000 kg by addition of water and any introduction of bleaching agents or other optical agents is avoided.

A deposition of the order of 12 to 15 gr/m$^2$ is carried out on the face to be printed.

Finally, the sheet is calendered in order to be endowed with a surface smoothness which is greater than 20 Beck.

EXAMPLE III

A pulp is formed by feeding the following materials into the upstream end of the paper machine:

- bleached hardwood chemical pulp containing less than 30 visible impurities per kg—62%
- bleached coniferous or softwood chemical pulp containing less than 30 visible impurities per kg—20%
- talcum powder—18%
- a minimum quantity of conventional acid sizing products,
- cationic retaining agent (cationized starch as sold by the Roquette Company under the trade name of Cato).

Any fluorescent dye or other bleaching agents are completely avoided and refining is limited to a minimum.

By means of a surface sizing press, a coating operation is performed with a starch preparation having a base of potato starch degraded by enzymation to a concentration of 10% without any fluorescent dye or any electrolyte.

The paper is calendered in order to give it a surface smoothness which is greater than 30 Beck.

A porosity of the finished paper is measured and must be within the range of 200 to 500 as measured in accordance with the Bendtsen method. This porosity is the indication of a low degree of refining in accordance with the known law which relates the degree of refining or beating to the porosity, this latter being a decreasing function of the degree of refining.

Furthermore, this paper which is manufactured in an acid medium has a pH which is lower than 7 as measured by the method of "determination of the pH of aqueous extracts of papers" as described in the AFNOR standard Q 03 005 or the ISO/DIS standard 6588.

The table given hereunder shows the analytical results of papers in accordance with the invention as produced in accordance with the foregoing examples I, II and III.

| | | Example I | Example II | Example III |
|---|---|---|---|---|
| Weight g/m$^2$ | | 80 | 90 | 95 |
| Surface resistivity (Keithley in $\Omega^2$: | | | | |
| (1) 50% RH | | $1.15 \times 10^{12}$ | $1.6 \times 10^{12}$ | $12.7 \times 10^{12}$ |
| (2) 75% RH | | $0.98 \times 10^{10}$ | $6 \times 10^{9}$ | $7 \times 10^{10}$ |
| Whiteness: | | | | |
| (1) Xenon with fluorescence, | | 97.8 | 93 | 81.6 |
| (2) Xenon without fluorescence, | | 80.6 | 81.6 | 81.6 |
| Burst factor (Mullen test) | | 22 | 18 | 30 |
| Load at break | | 4000 | 3800 | 6200 |
| Surface smoothness | Front side | 25.4 | 60 | 40 |
| | Reverse side | 40 | 30 | 40 |
| (Bckk test) | | | | |
| Ash content at 800° C. | | 24 | 26 | 15.8 |
| Optical density: | | | | |
| (1) 50% RH | | 1.28 | 1.15 | 1.26 |
| (2) 75% RH | | 0.96 | 0.82 | 1.12 |

It will be noted that, in Example I, the surface resistivity of the paper at 75% relative humidity (RH) is only $0.98 \times 10^{10}$ ohms square although it is wholly suitable for printing by magnetography.

However, by reason of the fact that the spacing of the electrodes for measuring surface resistivity is considerably greater than the thickness of the paper, the Keithley apparatus appears to be incapable of measuring the surface resistivity alone without measuring the resistivity of the interior of the paper at the same time unless both the surface and the interior are very different from an electrical standpoint. However, in the case of pigmented paper of the type considered in Example I and really having an insulating surface which attains the threshold value of resistivity at 75% relative humidity as required in accordance with the invention, the desired result is obtained although the Keithley apparatus is not capable of measuring this resistivity threshold.

The use of calcium carbonate (chalk) as a filler is conducive to the obtainment of high resistivity. However, it cannot readily be employed in an acid medium on account of its decomposition.

Under the conditions of exposure mentioned in the foregoing, namely successively at 20% and 50% relative humidity, a paper in accordance with Example III must have a surface resistivity greater than $3 \times 10^{12}$ ohms square.

This paper is uniform throughout its thickness and the surface resistivity—density relation is wholly satisfied in this case despite the limitations of the Keithley apparatus, in contrast to the coated and pigmented papers of Examples I and II.

As will be readily apparent, the invention is not limited in any sense to the examples described in the foregoing. Depending on the applications which may be contemplated, the invention may be extended to many alternative embodiments within the capacity of those versed in the art without thereby departing from the scope or the spirit of the invention.

What is claimed is:

1. A method of printing by magnetography under ambient atmospheric conditions of high relative humidity which exceeds 65 percent, the improvement comprising in which a magnetizable, fusable, magnetic ink in powdered form is transferred to a paper sheet and distributed on a temporary magnetizable support in accordance with the configuration to be reproduced, whereby the ink is fixed by fusion on the paper sheet, wherein the paper sheet employed has a surface resistivity of at least $10^{10}$ ohms square under relative humidity conditions of transfer of 50%, has a smoothness of at least 20 Bekk and comprises a cellulosic web substantially free from whitening agents, fluorescent dyes, bleaching agents, and electrolytes, the cellulose fibers used for manufacturing said web being substantially free of impurities, whereby precise magnetographic printing can be obtained at high humidity.

2. The method of claim 1 in which the relative humidity exceeds 75 percent, said method comprising using a paper sheet having a surface resistivity of at least $10^{12}$ ohms square in a relative humidity environment of 50% and at least $10^{10}$ ohms square in a relative humidity environment of 75%.

3. A method according to claim 1 in which the paper sheet has a porosity of the order of 200–300 measured in accordance with the Bendsen method.

4. The method according to claim 1 in which the paper sheet comprises (1) a cellulosic web containing an inorganic filler selected from the group consisting of talc, kaolin, and mixtures thereof, and (2) a starch-based surface coating on the surface to be magnetographically printed.

5. The method of claim 1 in which said paper sheet defines a surface coating free of inorganic materials.

6. The method of claim 5 in which said paper sheet carries a surface coating of starch based material.

7. A method of printing by magnetography under ambient atmospheric conditions of high relative humidity which exceeds 65 percent, the improvement comprising in which a magnetizable, fusable magnetic ink in powdered form is transferred to a paper sheet and distributed on a temporary magnetizable support in accordance with the configuration to be reproduced, whereby the ink is fixed by fusion on the paper sheet, wherein the paper sheet employed has a surface resistivity of at least $10^{12}$ ohms square under relative humidity conditions of transfer of 50 percent, has a smoothness of at least 20 Bekk and comprises a cellulosic web substantially free from whitening agents, fluorescent dyes, bleaching agents, and electrolytes, the cellulose fibers used for manufacturing said web being substantially free of impurities, said paper sheet defining a surface coating which is substantially free of inorganic materials.

8. The method of claim 7 in which said surface coating comprises a starch-based material.

9. The method of claim 8 in which the relative humidity exceeds 75 percent, said method comprising using a paper sheet having a surface resistivity of at least $10^{12}$ ohms square in a relative humidity environment of 50 percent and at least $10^{10}$ ohms square in a relative humidity environment of 75 percent.

10. The method of claim 9 in which the paper sheet has a porosity of essentially 200–300, measured in accordance with the Bendsen method.

* * * * *